US005205556A

United States Patent [19]

Stallman

[11] Patent Number: 5,205,556

[45] Date of Patent: Apr. 27, 1993

[54] GEODESIC GLOBE PUZZLE

[75] Inventor: William T. Stallman, Alameda, Calif.

[73] Assignee: Volunteers of America Bay Area, Inc., Oakland, Calif.

[21] Appl. No.: 886,667

[22] Filed: May 19, 1992

[51] Int. Cl.[5] ..... A63F 9/12; E04B 7/10; A63H 33/08

[52] U.S. Cl. ..... 273/157 R; 52/DIG. 10; 52/81.4; 446/488

[58] Field of Search ..... 273/155, 157 R, 153 R; 52/81, 537, 554, DIG. 10, 526; 446/388, 488

[56] References Cited

U.S. PATENT DOCUMENTS 1,292,188 1/1919 Wheeler ..... 446/488
3,203,144 8/1965 Fuller ..... 52/81
3,584,400 6/1971 Voges ..... 52/81
3,666,607 5/1972 Weissman ..... 446/488
4,620,842 11/1986 Wang ..... 446/488
4,976,652 12/1990 Schwartz ..... 446/388

*Primary Examiner*—V. Millin
*Assistant Examiner*—Steven Wong
*Attorney, Agent, or Firm*—Bruce & McCoy

[57] ABSTRACT

A geodesic globe formed of identical overlapping and interlocking specific geometric configuration segments formed of a bendable material which can be folded and interlocked whereby if the pieces are printed with portions of a map of the world they form a puzzle which can be assembled into a globe.

4 Claims, 3 Drawing Sheets

GEODESIC GLOBE PUZZLE

BACKGROUND OF THE INVENTION

1. Field of the Invention

The present invention relates to geodesic domes, and more particularly, to a geodesic globe made of a multiple of identical segments which can be imprinted with portions of the world map to form a puzzle.

2. Description of the Prior Art

The present invention is closely related to the work developed by Richard Buckminister Fuller who developed a laminar geodesic dome comprised of diamond configuration based panels arranged in overlapping relation which were weaved together to create inner and outer facing sheets. The Fuller geodesic dome is described in U.S. Pat. No. 3,203,144 issued Aug. 31, 1965, for a Laminar Geodesic Dome. The art described therein most closely related to the present invention is disclosed in FIGS. 12 through 16 and 18 and 21. There shown are globes or portions of globes formed from triangular panels. It will be shown that while the present invention utilizes the basic triangle configuration based panels, the panels are created and interlocked in completely different ways than envisioned by the Fuller patent.

SUMMARY OF THE INVENTION

The present invention is a geodesic dome comprised of identical, overlapping, interlocking segments. Each of the segments is made of a semi-rigid material which ca be bent along predetermined lines and defined by a specific geometric configuration. The geometric configuration is comprised of geometric subconfigurations and planes of juncture. The geometric subconfigurations of the identical geometric dome segments includes one narrow equilateral diamond and two wider equilateral diamonds joined along their edges to form a generally six-sided segment. The diamonds having equal length sides are joined along two sides of each of the diamonds to one side of each adjacent diamond with the apex of each diamond disposed proximate the center of the segment forming a common triple apex. Each of the geometric subconfiguration diamonds includes radiating cross-axes which radiate from the common apex. They also include longitudinal spanning axes which span the length of each subconfiguration diamond and generally form a triangle. The radiating cross-axes of one of the wider diamonds is split forming a V-shaped slot in the segment. The individual segments are formed to bend along each of the common or joined edge lines of the diamonds and along the spanning axes of the diamonds to angulate the adjacent surface planes of the diamonds with respect to each other and to cause each diamond to form two surfaces which are angulated with respect to each other on opposite sides of the spanning axes. Each of the subconfiguration diamonds includes two pairs of slots formed in the material and extending therethrough and forming tabs which interlock with similar slots and tabs formed in adjacent segments of the dome. The identical segments of the domes are interlocked together to form the dome by bending the segments along the diamond fold lines and cupping the segment by bringing the edges of the V-slot in close proximity and overlapping the segments in interlocking relations by means of slots to form a dome structure.

OBJECTS OF THE INVENTION

It is therefore a important object of the present invention to provide a new and novel method of creating a geodesic dome.

It is another object of the present invention to provide a new and novel element which can be interlocked with other identical elements to create a geodesic dome.

It is a further object of the present invention to provide a world globe puzzle created from identical pieces which can be interlocked to create a globe by virtue of their structure without the aid of adhesives or fastening members.

It is still another object of the present invention to create a world globe puzzle by printing portions of a world map on identical pieces of semi-rigid bendable pieces of material which can be interlocked to form a globe and thereby a world map if they are assembled in the correct orientation.

And it is yet another object of the present invention to disclose at least two different fastening means for interlocking the identical globe segments together.

Other objects and advantages of the present invention will become apparent when the disclosure of the specification is considered in conjunction with the accompanying drawings.

DESCRIPTION OF THE PREFERRED EMBODIMENT

Reference is made to the drawings for a description of the preferred embodiment of the present invention wherein like reference numbers represent like elements on corresponding views.

The present invention is a design for elements which can be assembled into geodesic domes or globes comprised of identical overlapping and interlocking segments. Each of the segments is made of a thin semi-rigid material which can be bent along predetermined lines and defined by a specific geometric configuration. The configuration is in turn comprised of several geometric subconfigurations and planes of juncture.

Figure 1:
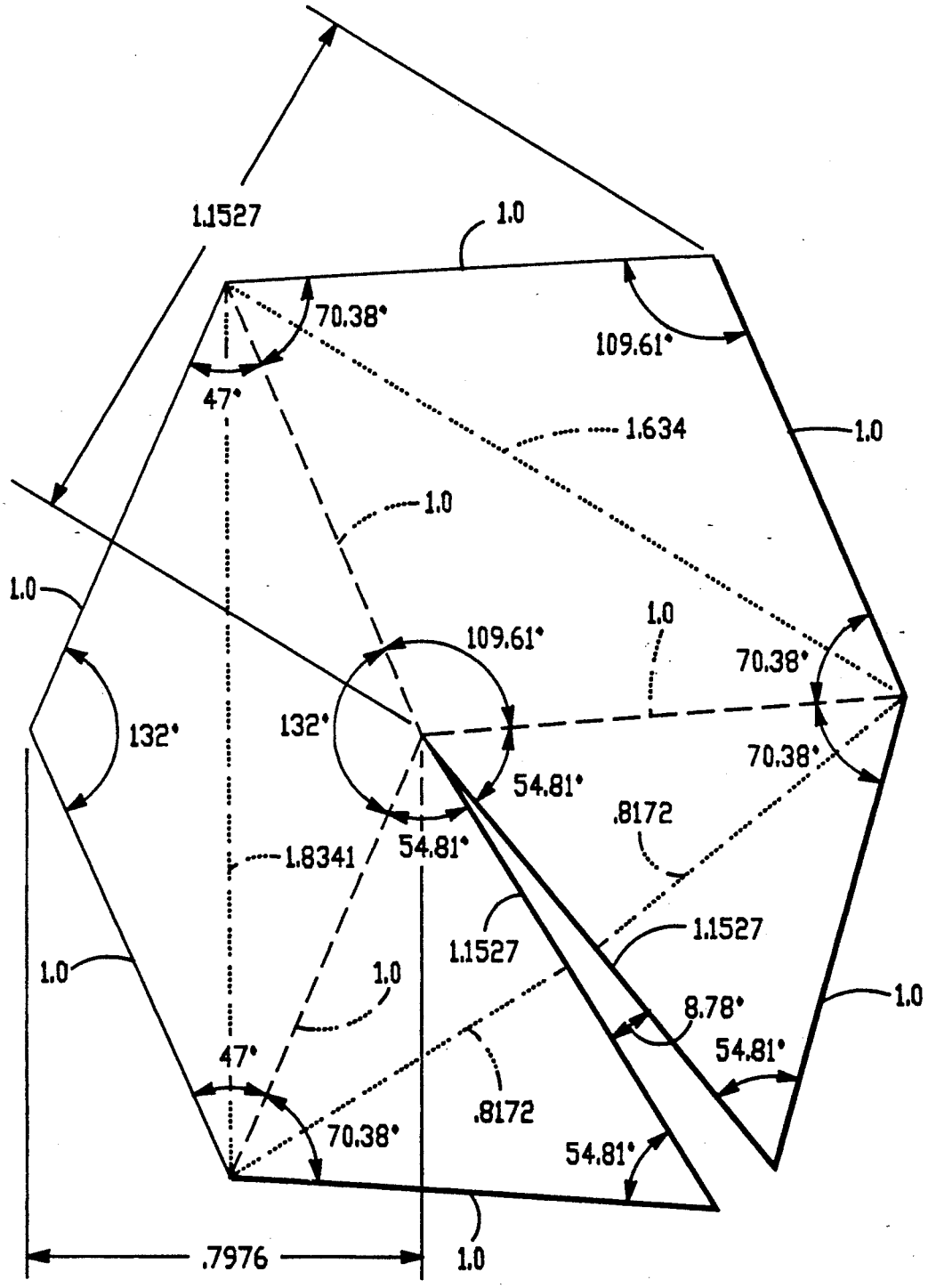
FIG. 1 is a top plan view of a schematic representation of a segment of the present invention which can be assembled into a globe showing the angular and size relations of the segment.
Figure 2:
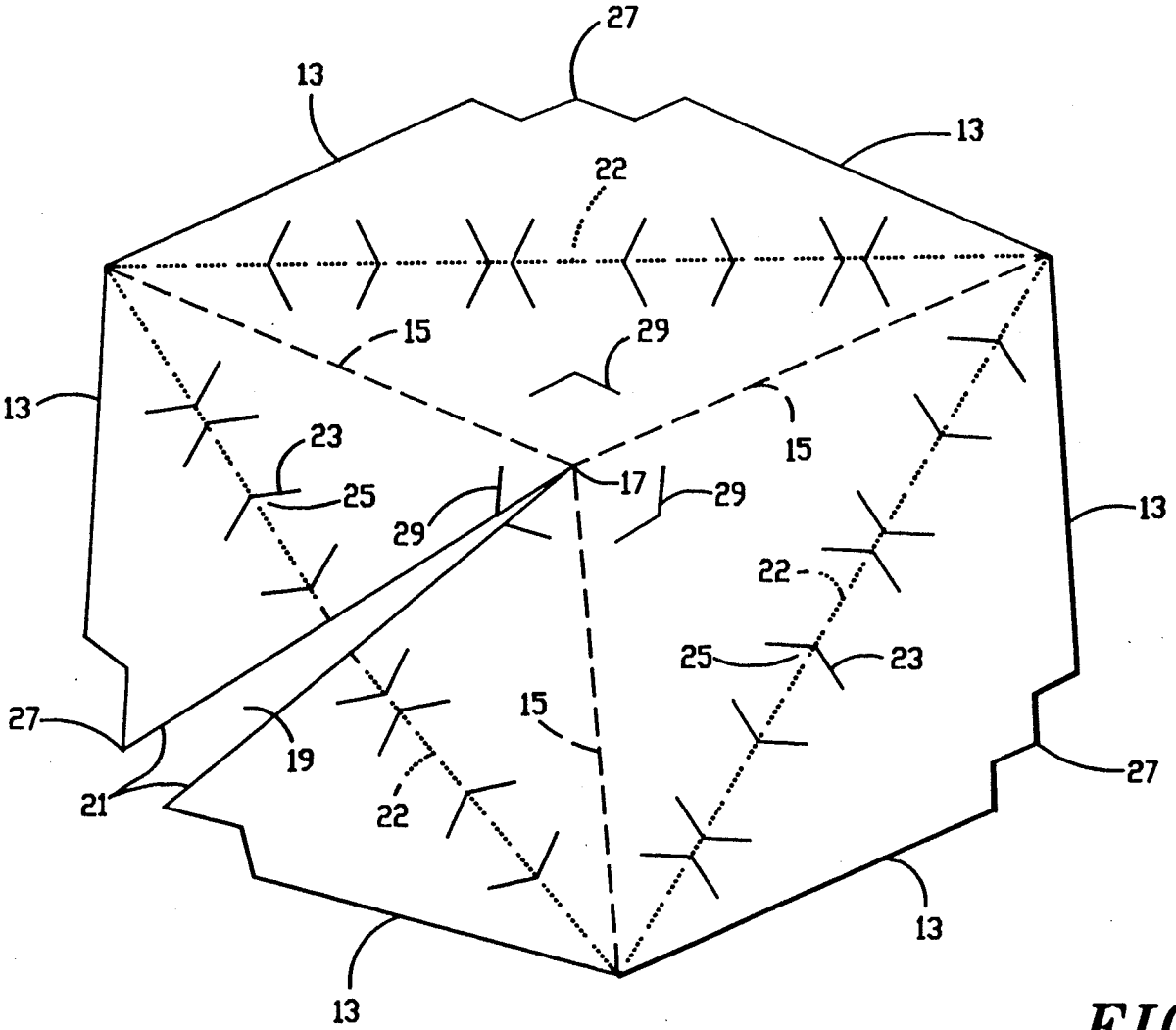
FIG. 2 is a top plan view of a preferred embodiment of a segment of the present invention.

Reference is made to FIG. 1 of the drawings which shows a first embodiment of one of the segments. FIG. 2 shows a different type of segment, but both of the segments have essentially the same configuration but vary in the details of the means by which the interlock of the segments is effected. Both of the segments, geometric subconfigurations are comprised of one narrow equilateral diamond disposed adjacent to two wider equilateral diamonds joined along their edges to form a generally six-sided segment. These diamonds are outlined by the two edge lines 13 of each diamond and the three dashed lines 15 radiating from the central triple apex 17 of the diamonds. Each diamond outline has two edge lines 13 and two dashed lines 15, the latter of which it shares with the other two diamonds. There is a slit 19 formed in one of the diamonds which actually causes the segment to have eight sides in its flat configuration. The three diamonds have equal length sides. The wider diamond of the segment, which has the slit formed therein, forms two edges 21 of the segment adjacent to that slit.

Figure 3:
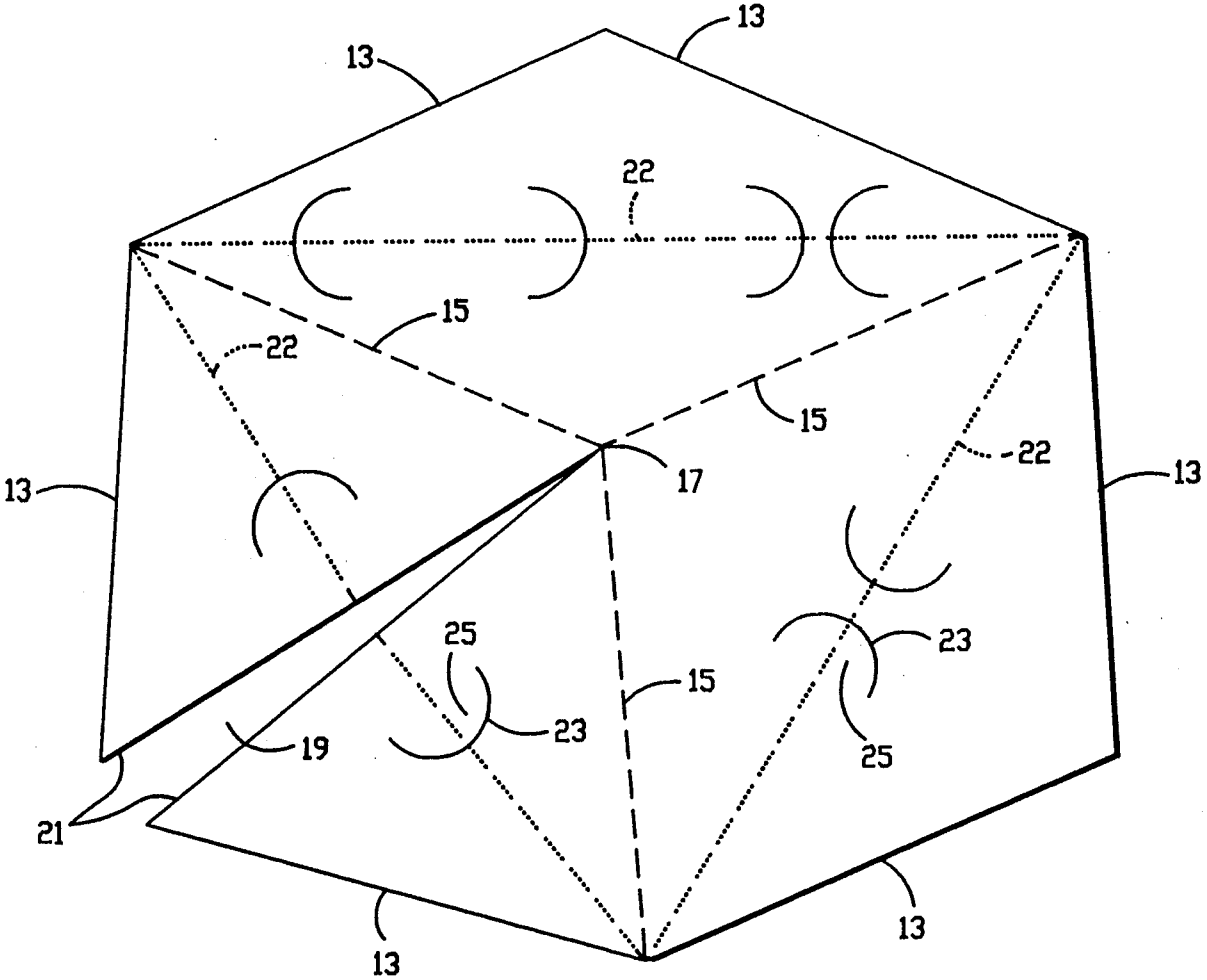
FIG. 3 is a top plan view of an alternative embodiment of a segment of the same invention.

Reference is made to FIG. which illustrates the geometric and size relations of the segment configuration. Reference is made to FIGS. 2 & 3 for the nomenclature identification of the elements of the segments. Each of the sides 13 & 15 of the diamonds is labelled in FIG. 1 with the number 1.0 which represents unity and all other lengths of the FIG. are represented by numbers which bear the length relation of that measurement with respect to the side lengths. The angular relationships of the lines forming the diamonds are also illustrated in FIG. 1.

Each diamond is joined along two adjacent sides 15 to one side of each adjacent diamond whereby each diamond has two of its sides located with a common edge line 15 with each of the other two diamonds. The common edge lines form an apex 17 for each diamond which is disposed proximate the center of the segment forming a common triple apex. The borders of these diamonds located on the interior portion of the segment are defined in the FIGS. by the dashed lines 15 which, in fact, are score lines which are formed in the segment material to permit it to be bent along those same edge lines. The edge lines radiate from the common triple apex of the diamonds and outline the three interior sides or edges of the diamonds.

Each of the geometric subconfiguration diamonds includes longitudinal spanning axes 22 which span the length of each subconfiguration diamond and generally cause the subconfiguration diamonds to form two sub-subconfiguration triangles. The longitudinal spanning axes 22 are indicated in the FIGS. by dotted dashed lines which are also score lines formed on the segment whereby the diamonds can also be folded along those lines as well as the common edge lines 15.

The cross-axis of one of the wider of the two diamonds which radiates from the common apex 17 of the diamonds is split and forms a V-slot 19 in the segment creating the additional two sides 21 (length 1.1527 each) of the generally six-sided segment. This slit (angle 8.87°) allows the segment to form a shallow cup when the segment is bent along the score lines and the edges of the slit are brought into close proximity. The length of the sides of the slit are the same length of the cross-axis of the other wider diamond.

The segments are formed to be bent along each of the common or joined edge lines of the diamonds, the dashed lines, as well as along the spanning axes 22, the dotted dashed lines, to angulate the adjacent surface planes of the diamonds with respect to each other and to cause each diamond to form two surfaces which are angulated slightly with respect to each other on opposite sides of the spanning axes.

Each of the geometric subconfiguration diamonds includes pairs of slots 23 formed in the material it is made out of and they extend therethrough and form tabs 25 which interlock with similar slots and tabs formed in adjacent segments of the dome structure when it is assembled.

In the segment configuration embodiment of the invention illustrated in FIG. 3, the slots 23 are comprised of the semi-circular cuts which penetrate through the segment and are centered on the longitudinal spanning axes of each of the subconfiguration diamonds. The semi-circular slots are oriented with the cut extending equal distance to each side of the spanning axes of the geometric subconfiguration diamonds.

In the segment illustrated in FIG. 2 of the drawings, the slits 23 which project through the segment to form the interlock tabs 25 are in the form of chevrons centered with the apexes of the chevron on the longitudinal spanning axes 21 with the wings of the chevrons disposed equal angular to the spanning axes. In this configuration, the apexes of each of the diamonds of the segment, disposed at the opposite end of the cross-axes radiating from the common triple apex of the diamonds, and disposed at the edge of the segment, is truncated 27.

Each of the geometric subconfiguration diamonds in this embodiment of the segment design, as illustrated in FIG. 2, also includes two sets of chevron slots formed in the material and extending therethrough. The first set of slots (not numbered) includes two pairs of chevron slots disposed cross-wise to, and centered on, the spanning axes 21 of the geometric subconfiguration diamonds with the ends of the chevron slots being spaced equal distance from each other and the apex of each of the chevron slots being located on the spanning axes of each of the diamonds. The pairs of chevron slots disposed on the spanning axes alternate in their orientation with the apexes of the slots aimed toward each other and then away from each other in alternating sequence. The two closest pairs of chevron slots on the spanning axes of adjacent diamonds are of opposite orientation.

The second set of slots 29 is formed on the radiating cross-axes (not illustrated) of the diamonds proximate the ends thereof with the apexes of the chevron slots both aimed outward from the center apex towards the edges of the segments. The side of the chevron slots formed at the outer ends of the radiating axes are removed from the diamonds forming the truncated apexes 27 on the subconfiguration diamonds in the outline of a shallow letter "W".

The segments are interlocked together to form a dome by bending the segments along the diamond edge fold lines and along the spanning axes and cupping the segment by bringing the edges of the V-slot in close proximity and overlapping the segments in interlocking relation by means of the slots to form a dome structure. While a description of this configuration is difficult to put in words, the assembly of the globe or dome from the segments is a puzzle in which the proper configuration of the segments readily becomes apparent when the segments are printed with portions of a world map. When the segments are interlocked to form a globe, a world map can be generated if the segments are assembled in the proper orientation. Children have already demonstrated the ability to assemble the segments.

The proportions of the segments are exacting in order to create a dome or globe structure. Reference is made to the FIG. 1 for a consideration of these proportions. The spacing of the slots in the segments likewise needs to be accurately determined. These are shown in FIGS. 4 & 5. It will be seen in FIG. 4 that the crease line for the semi-circular tabs, which is disposed perpendicular to the longitudinal spanning axes, is placed 15 units on each side of the radiating cross-axes and 15 units from the two edges of the slot formed in one of the larger of the two larger diamonds. The narrower of the three geodesic subconfiguration diamonds includes two sets of semi-circular slots, one of which has the tabs 25 which are created by the slots in the segment, disposed towards each other, and the other of which the tabs are aimed away from each other. In each instance, however, the fold lines of the slots are disposed at 15 units from the cross-axes of the narrow diamond and 40 units on opposite sides of the narrow axes of the cross-axes. In the two larger diamonds of the geometric subconfiguration, one of the sets of tabs faces towards each other from their fold lines and that set is the one which is closest to the similar set of slots formed in the narrower diamond. The other of the wider diamonds has the tabs facing away from each other similar to the adjacent tabs and slots formed in the narrower diamond.

Reference is made to FIG. 5 of the illustrations which shows the alternative embodiment of the segment using chevron slots rather than semi-circular slots. In that configuration, the edge lines of the diamonds are likewise still 53 units and the length of the cross-axes of the wider diamonds without the slot is 61 units and the length of the cross-axis of the narrower of the diamonds is 42 units. In this design, the numbers and pairings of chevron slots are different than with the semi-circular slots shown in FIG. 1. In the segment using the chevron slots, each of the two larger diamonds includes four pairs of chevron slots in which the apexes alternate between aiming toward each other and aiming away from each other and in each correlation of those slots with the comparable slots in the narrower subconfiguration diamond the slots alternate as opposites whereby the two closest slots in the thicker diamonds with the narrower diamonds have the chevrons facing away from each other, or towards each other opposite to that with the adjacent or paired slot in the narrower diamond. For instance, slots AA compared with slots BB are opposite in cut. The angulation of the slots with respect to the cross-axes of the diamonds is approximately 35 degrees. The spacing between the ends of the slots is always approximately 8 units.

The slots disposed on the cross-axes (not illustrated) as opposed to the longitudinal spanning axes and which have the apexes aimed outward from the central apex are disposed equal distance from the apex and the same distance from the ends of the cross-axes where they would occur if the longitudinal edges were exposed to the point of juncture. The angulation of the chevrons with respect to these cross-axes is also 35 degrees, and the angled cut which removes the portion of the three diamonds at the outer ends of the cross-axes is likewise angled at 35 degrees to the cross-axes, forming the truncated external apexes 27 of the subcombination diamonds. The material forming the segments is scored along the radiating diamond edge lines from the central apex, dashed lines, and along the longitudinal spanning axes, dotted dashed lines, so that the segments can be folded along those lines. When each of the segments have been folded and assembled into a globe, it is comprised of 60 segments of which only 30 trapazoids are visible due to the overlap of the segments during assembly.

Thus it will be apparent from the foregoing description of the invention in its preferred form that it will fulfill all the objects and advantages attributable thereto. While it is illustrated and described in considerable detail herein, the invention is not to be limited to such details as have been set forth except as may be necessitated by the appended claims.

I claim:

1. A geodesic dome comprised of identical overlapping and interlocking segments, each of said segments being made of a semi-rigid material which can be bent along predetermined lines and defined by a specific geometric configuration, said geometric configuration being comprised of several geometric subconfigurations and planes of juncture including one narrow equilateral diamond and two wider equilateral diamonds joined along their edges to form a generally six-sided segment, said diamonds having equal length sides and being joined along two sides of each diamond to one side of each adjacent diamond with an apex of each diamond disposed proximate the center of said segment forming a common triple apex, each of said geometric subconfiguration diamonds including radiating cross-axes which radiate from the common apex and longitudinal spanning axes which span the length of each subconfiguration diamond and generally form a triangle, the radiating cross-axis of one of the wider diamonds being split and forming a V-shaped slot in said segment, said segments being formed to bend along each of the common or joined edge lines of said diamonds and along said spanning axes to angulate the adjacent surface planes of the diamonds with respect to each other and to cause each diamond to form two surfaces which are angulated with respect to each other on opposite sides of said spanning axes, each of said diamonds including pairs of slots formed in said material and extending therethrough and forming tabs which interlock with similar slots and tabs formed in adjacent segments of said dome, said segments being interlocked together to form said dome by bending said segments along said diamond joined edge lines and said spanning axes and cupping said segment by bringing the edges of said V-slot into close proximity and overlapping said segments in interlocking relation by means of said slots to form a dome structure.

2. The geodesic dome of claim 1 wherein the apex of each of said diamonds is disposed at the opposite end of said radiating cross-axis from said common point of apex and disposed at the edge of said segments being truncated, and each of said diamonds includes two sets of chevron slots formed in said material and extending therethrough, the first set of slots including two pairs of chevron slots formed cross-wise to and centered on said spanning axes of said subconfiguration diamonds with the ends of said chevron slots being spaced equal distance from each other and the apex of each of said chevron slots being located on the spanning axes of each of said diamonds, the second set of slots being formed on the radiating cross-axes of said subconfiguration diamonds proximate the ends thereof with the apexes of said chevron slots both aimed outward from said center apex, the side of said chevron slots formed at the outer ends of said radiating axes being removed from said diamonds forming said truncated apexes of said subconfiguration diamonds.

3. The dome structure of claim 1 wherein said segments are printed with portions of a world map whereby if the segments are interlocked to form a globe, a world map is generated.

4. A geodesic dome comprised of identical overlapping and interlocking segments, each of said segments being made of a semi-rigid material which can be bent along predetermined lines and defined by a specific geometric configuration, said geometric configuration being comprised of several geometric subconfigurations and planes of juncture including one narrow equilateral diamond and two wider equilateral diamonds joined along their edges to form a generally six-sided segment, said diamonds having equal length sides and being joined along two sides of each diamond to one side of each adjacent diamond with an apex of each diamond disposed proximate the center of said segment forming a common triple apex, each of said geometric subconfiguration diamonds including radiating cross-axes which radiate from the common apex and longitudinal spanning axes which span the length of each subconfiguration diamond and generally form a triangle, the radiating cross-axis of one of the wider diamonds being split and forming a V-shaped slot in said segment, the apex of each of said diamonds disposed at the opposite end of said radiating cross-axis from said common point of apex and disposed at the edge of said segments being truncated, said segments being formed to bend along each of the common or joined edge lines of said diamonds and along said spanning axes to angulate the adjacent surface planes of the diamonds with respect to each other and to cause each diamond to form two surfaces which are angulated with respect to each other on opposite sides of said spanning axes, each of said diamonds including pairs of slots formed in said material and extending therethrough and forming tabs which interlock with similar slots and tabs formed in adjacent segments of said dome, each of said diamonds including two sets of chevron slots formed in said material and extending therethrough, the first set of slots including two pairs of chevron slots formed cross-wise to and centered on said spanning axes of said subconfiguration triangles with the ends of said chevron slots being spaced equal distance from each other and the apex of each of said chevron slots being located on the spanning axes of each of said diamonds, the second set of slots being formed on the radiating slots of said subconfiguration diamonds proximate the ends thereof with the apexes of said chevron slots formed at the outer ends of said radiating axes being removed from said diamonds forming said truncated apexes of said subconfiguration diamonds, said segments being interlocked together to form said dome by bending said segments along said diamond joined edge lines and said spanning axes and cupping said segment by bringing the edges of said V-slot into close proximity and overlapping said segments in interlocking relation by means of said slots to form a dome structure, and said segments being printed with portions of a world map whereby if the segments are interlocked to form a globe, a world map is generated if the segments are correctly arranged.

* * * * *